US005424751A

United States Patent [19]

Collier

[11] Patent Number: 5,424,751

[45] Date of Patent: Jun. 13, 1995

[54] MOTOR DRIVEN SHUNT FOR GAMMA MATCH ANTENNA

[76] Inventor: Coleman D. Collier, 1608 May St., Denton, Tex. 76201

[21] Appl. No.: 182,774

[22] Filed: Jan. 18, 1994

[51] Int. Cl.[6] ..... H01Q 9/00; H01Q 9/16

[52] U.S. Cl. ..... 343/747; 343/745

[58] Field of Search ..... 343/747, 745, 746, 748, 343/749, 750, 751, 722; H01Q 9/00, 9/16

[56] References Cited

U.S. PATENT DOCUMENTS 2,976,532 3/1961 Guest ..... 343/745
4,184,165 1/1980 Vye ..... 343/861
5,072,233 12/1991 Zanzig ..... 343/748

*Primary Examiner*—Donald Hajec
*Assistant Examiner*—Hoanganh Le
*Attorney, Agent, or Firm*—John E. Vandigriff

[57] ABSTRACT

The invention is to a gamma matching antenna in which a motor driven shunt is used to adjust the gamma match feed line. The shunt is movable along the antenna driven element and the gamma march rod on brushes or rollers that are in good electrical contact with the gamma rod and driven element, and allows the shunt to move along both element without binding. A control circuit moves the shunt in response to, and to minimize the SWR of the antenna.

19 Claims, 7 Drawing Sheets

MOTOR DRIVEN SHUNT FOR GAMMA MATCH ANTENNA

FIELD OF THE INVENTION

This invention relates to radio antennas, and more particularly to a tunable gamma match antenna.

BACKGROUND OF THE INVENTION

Radio frequencies are allocated by the Federal Communication Commission to particular uses. Allocations of the radio spectrum for radio amateurs has present a problem in that the width of any given band is too wide for a single antenna. Antennas that are available to radio amateur operators can tune only a portion of any given band. When an operator installs an antenna, he has to decide in which portion of a given band that he wishes to operate. The antenna is then tuned to that portion of the band, and the operator can only efficiently operate in that portion of the band.

If the operator wishes to operate in a different portion of a given band of frequencies, the antenna has to be taken down and returned for that different portion of the band. Since antennas are mounted high in the air on a antenna mast, it is not practical to retune the antenna.

An alternative to retuning the antenna is to use an antenna tuner. This method of retuning only hides the effects of a mistuned antenna from the operators transmitter, is not efficient and does not solve the basic problem. Antenna tuners use variable capacitors and coils. Example of antenna tuners are found in U.S. Pat. Nos. 3,653,053 and 2,976,532. U.S. Pat. No. 2,976,532 uses capacitive tuning.

Telescoping antenna construction can be used to tune antenna, but this does not eliminated the need to remove an antenna from its mount to retune by sliding the telescoping elements. U.S. Pat. No. 4,620,194, uses telescoping elements for all of the elements. The sliding of telescoping elements provides an inductive change, retuning the antenna. This antenna also has to be accessed to change the tuning, and clamps loosened to retune the sliding elements.

SUMMARY OF THE INVENTION

The invention is to a gamma matching fed antenna in which a motor driven shunt is used to adjust the inductance of the gamma match feed system. The shunt is movable along the antenna driven element and the gamma matching rod, and varies the inductance of the feed system. The shunt moves along the gamma matching rod and antenna driven element with brushes or rollers that are in good electrical contact with the gamma rod and driven element, and allows the shunt to move along both elements without binding.

A D.C. powered motor is mounted on the antenna and connected to the shunt by a worm gear allowing accurate movement of the shunt. Retuning is possible by the operator from a remote location. Accurate tuning is made possible by using a SWR meter to accurately place the shunt to tune the antenna to the desired frequency. By remote tuning the operator can change portions of a band, and have access to the entire frequency band without having to manually tune the antenna with each wide frequency change.

In one embodiment of the invention, automatic tuning is possible by utilization of a comparison circuit which detects with the SWR is minimum for the desired transmitting frequency.

The technical advance represented by the invention, as well as the objects thereof, will become apparent from the following description of a preferred embodiment of the invention when considered in conjunction with the accompanying drawings, and the novel features set forth in the appended claims.

DESCRIPTION OF PREFERRED EMBODIMENT

Figure 1:
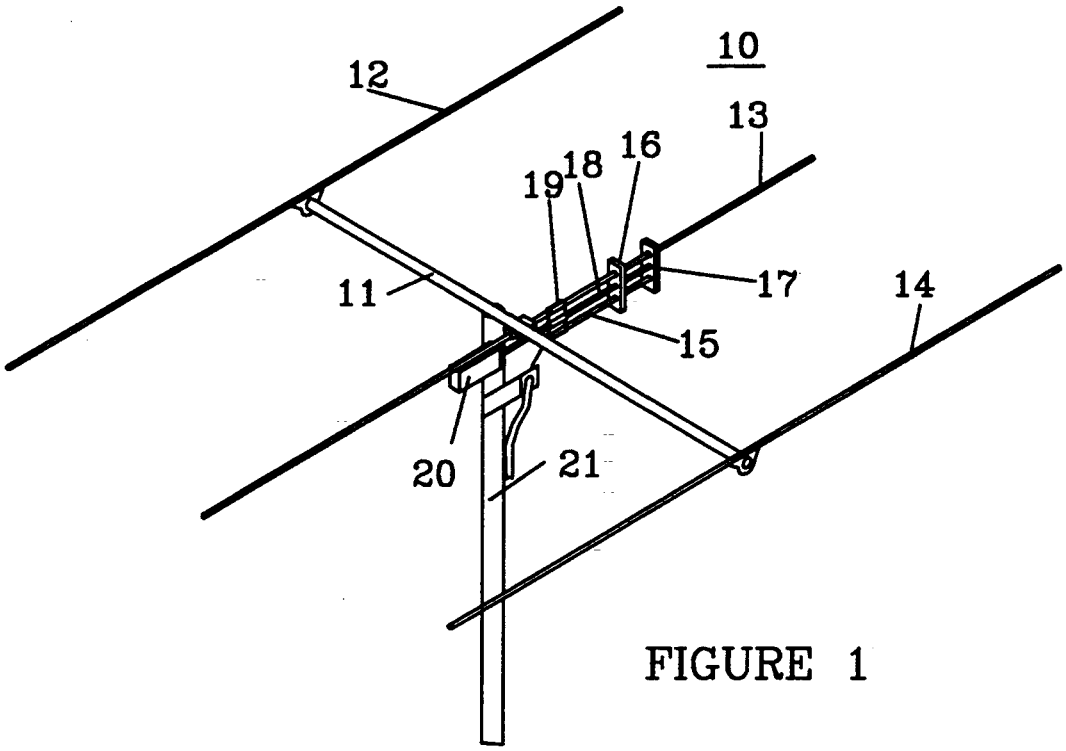
FIG. 1 shows an antenna array utilizing the tuning apparatus of the present invention.

FIG. 1 shows a 10 gamma matching antenna array 10 having a support arm 11, mounted on mast 21, and three elements 12, 13 and 14. A shunt 16 is movable along the antenna driven element 13 and the gamma match rod 15. Shunt 16 moves along gamma match rod 15 and antenna driven element 13 along brushes or rollers (described below) that are in good electrical contact with the gamma rod and driven element. The brushes or rollers allow the shunt to move along both element without binding.

Gamma matching rod 15 is mounted on driven element 13 by insulators 17 and 19. Shunt 16 is moved along element 13 and rod 15 by drive screw 18 that is turned by motor 20. Motor 20 may be mounted by an insulator to element 13, or may be secured to mast 21 by a mounting bracket (not illustrated). Motor 20 is preferably a D.C. motor that may be turn both clockwise and counter clockwise to turn screw 18 to move shunt 16 between mounting insulators 17 and 19. As shunt 16 is moved along element 13 and rod 15 gamma match tuning of antenna 10 is accomplished.

Figure 2:
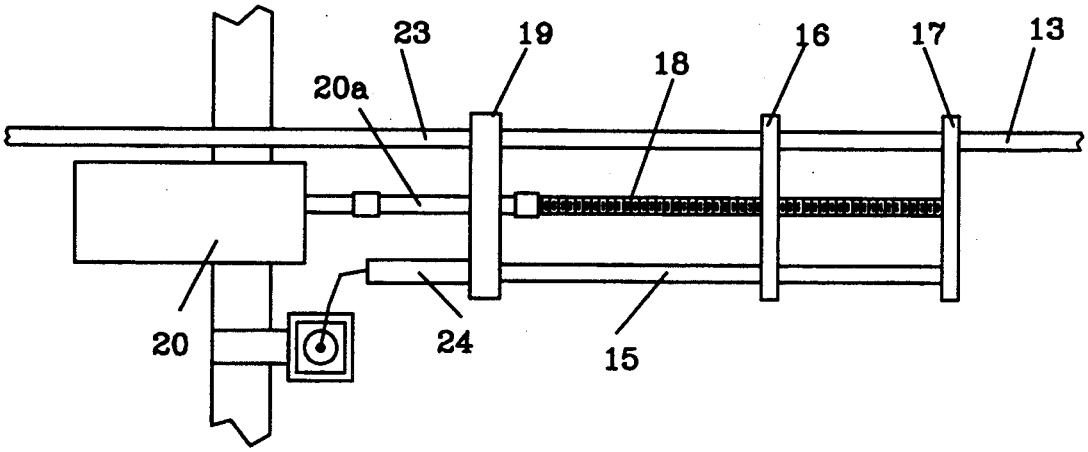
FIG. 2 shows the tuning apparatus of the present invention.

FIG. 2 shows the gamma match tuning rod 15 and antenna element 13 secured together by insulators 17 and 19. Both insulators 17 and 19 are secured to element 13 and rod 15, holding them in a fixed relationship to each other. Motor 20 is attached to screw element 18 by non-conductive coupling 20*a*. Screw element 18 extends through insulator 19 and ends at insulator 17. Screw 18 turns freely in both insulators 17 and 19. Shunt 16 is internally threaded to match the threads on screw 18. Therefore, as screw 18 is turned, shunt 16 will move along antenna element 13 and rod 15. Terminal 21, on insulator 19 is attached to gamma rod 15, and is the antenna signal feed terminal. Terminal 23, on SO239 connector is attached to boom 21 and provides the ground connection to the antenna. An SO 239 connector is an R.F. terminal with ground attached through the body of the connector and the center feed is through a connector insulated from the body of the connector. When a coaxial wire is used, the center wire of the coaxial cable is attached to terminal 24, the feed point. Shield brad wire is attached to terminal 23.

Figure 3:
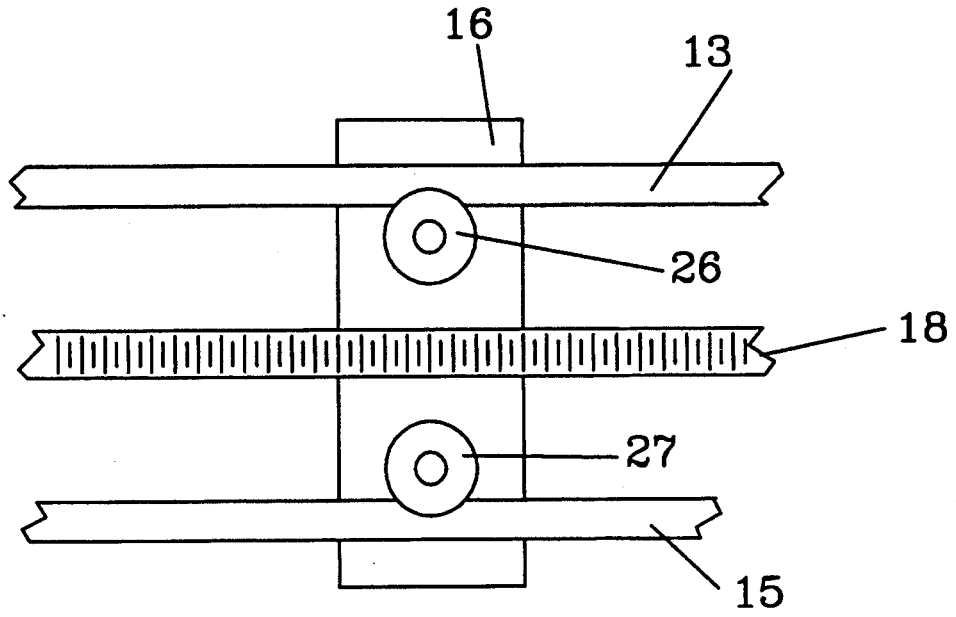
FIG. 3 shows a first embodiment of a shorting bar.

FIG. 3 illustrates one embodiment of shunt 16. Shunt 16 is a shorting element between antenna element 13 and rod 15. As shunt 16 is moved along element 13 and rod 15, the inductance of the feed system is changed, and the antenna is effectively tuned to different frequencies. In FIG. 3, the contact between element 13 and rod 15 are rollers 26 and 27. As screw 18 turns, shunt 16 moves along element 13 and rod 15 in contact with rollers 26 and 27. Rollers 26 and 27 provide a smooth rolling contact for shunt 16 with element 13 and rod 15. Only one-half of shunt 16 is shown in FIG. 3. Rollers 26 and 27 are mounted between two halves of shunt 16, to encase then.

Figure 4:
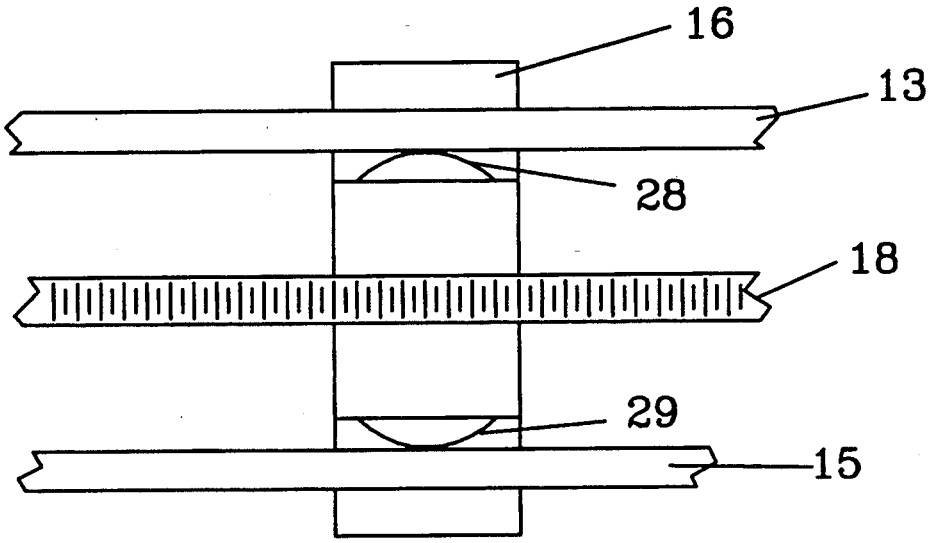
FIG. 4 shows a second embodiment of a shorting bar.

FIG. 4 illustrates another embodiment of shunt 16. In this embodiment, two slide contacts 28 and 29 replace the rollers of FIG. 3. As shunt 16 moves along element 13 and rod 15, electrical contact is made via spring slide or brushes 28 and 29. Brushes 28 and 29 are of a spring material to maintain contact with element 13 and rod 15 as shunt 16 moves along them.

Figure 5:
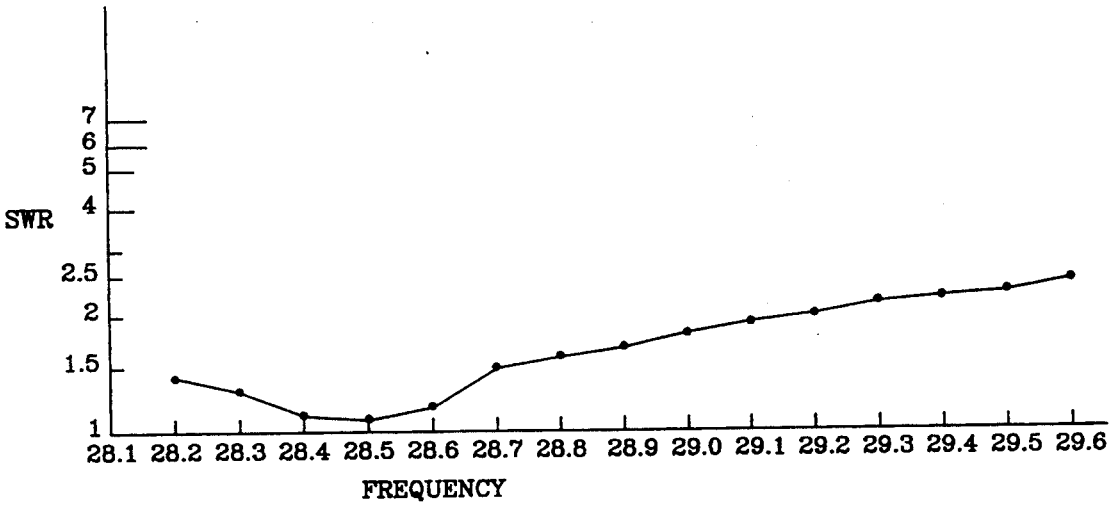
FIG. 5 shows a standing wave chart for the shunt located as indicated in FIG. 5*a;*
Figure 5A:
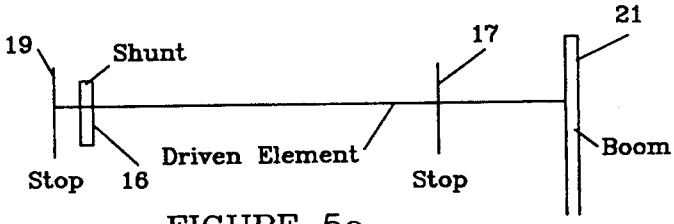

FIG. 5 is a plot of Standing Waver Ratio (SWR) for the antenna when the transmitter tuned frequency $F_o$ is 28.4 megahertz, and as shown in FIG. 5*a*, the shunt is positioned fully extended away from the antenna mast or boom. With the shunt fully extended, the SWR does not exceed about 2.0 for frequencies 28.0 mhz to 28.8 mhz. As the shunt is moved toward the boom, the SWR rises for this frequency range.

Figure 6:
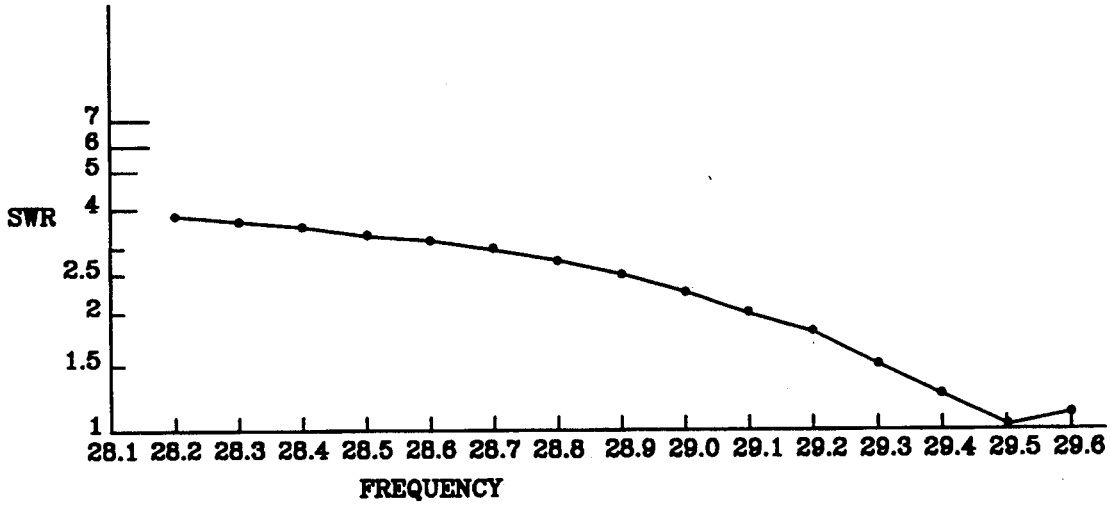
FIG. 6 shows a standing wave chart for the shunt located as indicated in FIG. 6*a;*
Figure 6A:
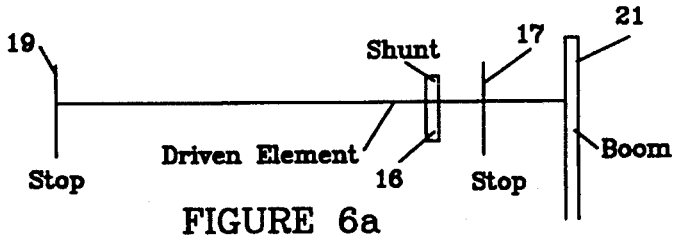

FIG. 6 is a plot of SWR for a tuned Frequency $F_o$ of 29.5 Mhz, and a tuning range of 28.2 mhz to 29.0 mhz. This example, as illustrated in FIG. 6*a*, the shunt is moved to its extreme position toward the boom.

From the above plots, it may be observed that by positioning the shunt during tuning, the antenna may be tuned to a minimum SWR over the band of frequencies from 28.0 mhz to 29.7 mhz., with the SW always below 2.0. This is important because modern transmitters being built today will not operate at full output power if the SWR is above 2.0.

The tuning of the antenna may be done by a hand operated switch with the operator watching the SWR meter for minimum reading, or the tuning of the antenna and positioning of the shunt may be accomplished automatically as the transmitter attached to the antenna is tuned to a desired frequency.

Figure 7:
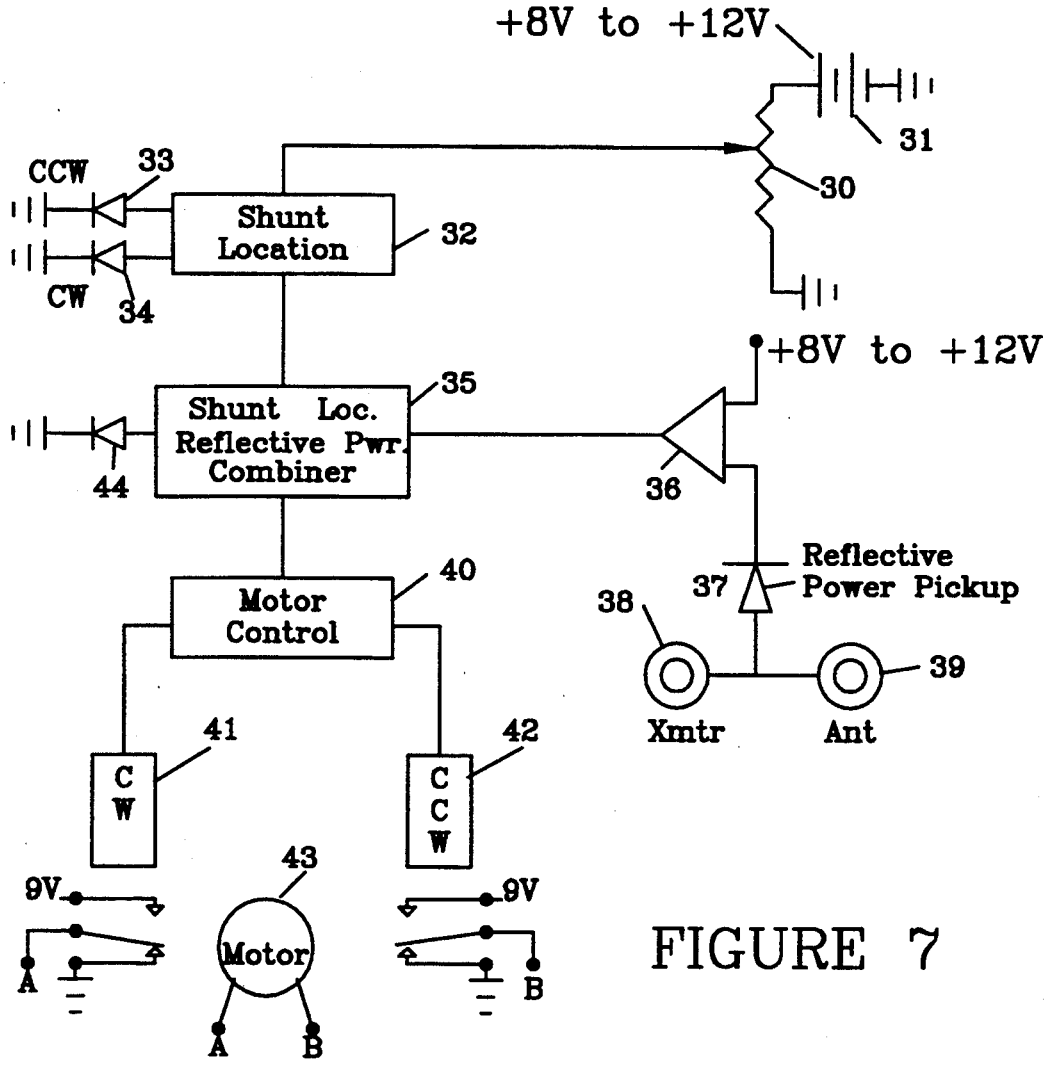
FIG. 7 illustrates an example of a tuning control circuit in block form.

Illustrated in FIG. 7 is an example of a circuit, in block form, for adjusting the shunt to minimize SWR. Mounted on the antenna is a transducer 30, in the form of, for example, a variable resistor which is turned as the shunt is moved. One end of resistor 20 is grounded and the other end is connected to a voltage source 31. The resistor provides a signal which is proportional to the relative position of the shunt. As the shunt movers along the driven element and the gamma matching rod, a signal is from the resistor 30 is transmitted to a comparator circuit 32. this signal is processed to determine proper motor rotation in the event the reflected power from the antenna exceeds a predetermined level. A signal form the comparator is then sent to a combiner circuit 35. When reflected power from the antenna exceeds the predetermined level, a voltage from reflective power pickup diode 37 is coupled to combiner circuit 35. When a signal is received from both the shunt location circuit 32 and the reflective power pickup diode 37, then either relay 41 or 42 is actuated to turn motor 43 in a direction, clockwise or counter clockwise, to bring the reflective power level below a predetermined level.

Figure 8:
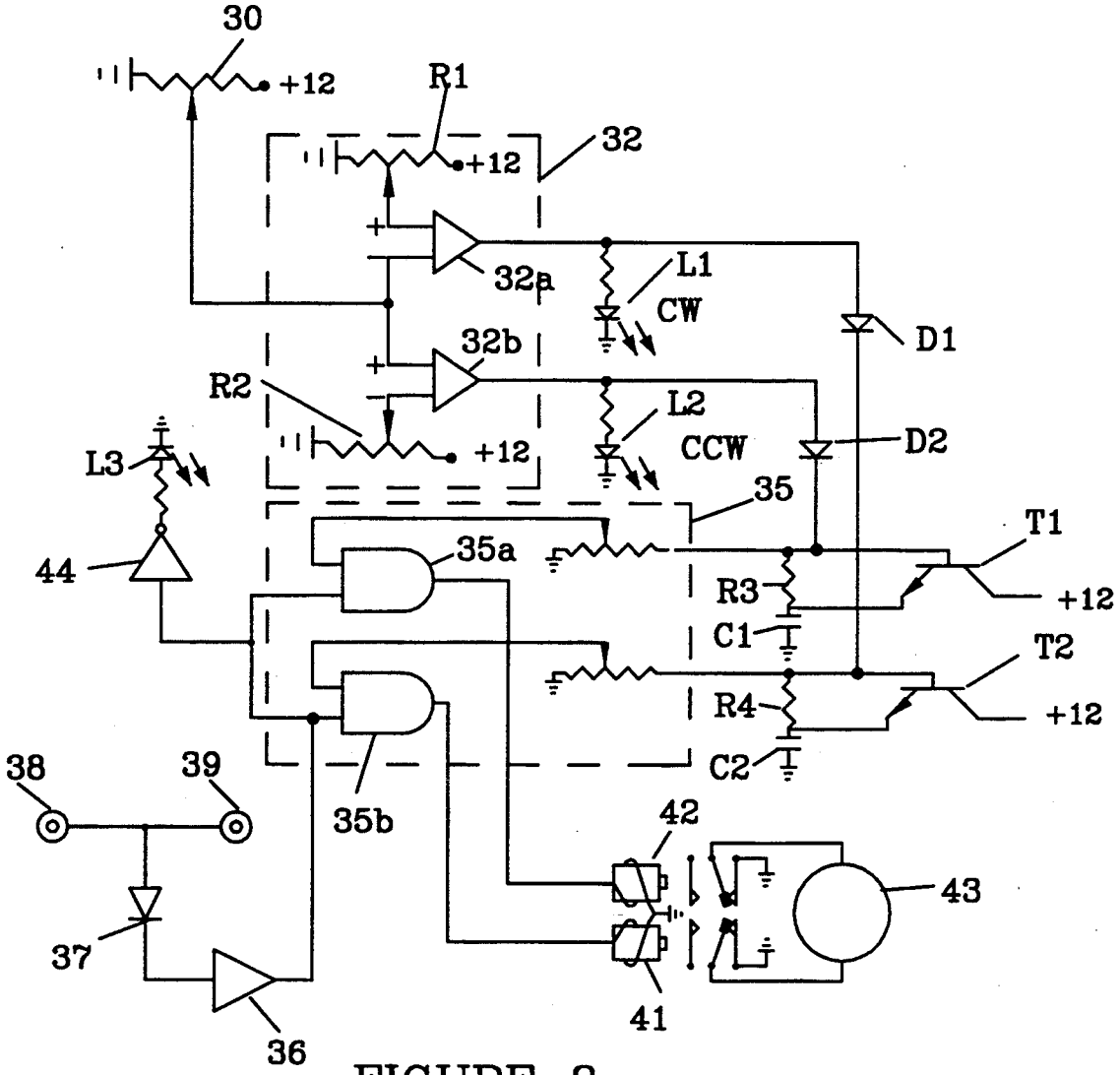
FIG. 8 illustrates one embodiment of a tuning control circuit.

FIG. 8 is an example of a circuit that may be used in controlling motor 43 to tune the antenna. Numbers in the circuit of FIG. 8 correspond with the numbers of FIG. 7 for the same parts. Transducer 30 is driven on the antenna by motor 43. A voltage, representative of the position of the tuning shunt 16 is applied to two comparison amplifiers 32*a* and 32*b*. Depending upon the bias setting on the resistors R1 and R2, one of the two comparison amplifiers will out put a signal, indicated by either light emitting diodes L1 or L2, indicating the direction of movement, clockwise (CW) or counter clockwise (CCW), of drive motor 43. The output signal is coupled through a diode (D1 or D2) to a timing-bias circuit made up of transistor T1, R3 and C1 for CCW direction and T2, R4 and C2 for CW direction. The output signal is applied to an AND gate, 35*a* or 35*b*, to which is also applied a signal fork the reflective power circuit (37, 36). Dependent upon which signal is being applied to the and gates, a CW or CCW signal from the comparator circuit 32, either relay 41 or 42 will be closed turn motor 43 in the appropriate direction to reduce the reflective power signal (SWR) to a minimum. At this point, motor 43 will be stopped. LED L3 is a ready light indicating when the antenna has been tuned to reduce the SWR to a minimum.

The timing circuits of T1, R3, C1 and T2, R4, C2 are used to prevent the circuit from reacting from every instantaneous change of the output of transducer 30, and to give motor 43 time to move the shunt to a position to reduce the SWR to a minimum.

What is claimed:

1. A gamma matching tunable antenna array including an antenna driven element and a gamma match rod, comprising:

a movable shunt shorting between said driven element and gamma match rod to tune the antenna array to a desired frequency;

a screw connected to said movable shunt through a threaded hole;

a reversible motor connected to one end of said screw; and a control circuit for driving said motor in a desired direction to move said shunt and to tune said antenna to a desired transmitting frequency.

2. The antenna array according to claim 1, wherein said shunt has openings therein through which said driven element and gamma match rod extend, shorting the driven element and gamma match rod together.

3. The antenna array according to claim 1, wherein said shunt moves along and is in contact with said driven element and gamma match rod by rollers.

4. The antenna array according to claim 1, wherein said shunt moves along and is in electrical contact with said driven element and gamma match rod by compressible spring brushes.

5. The antenna array according to claim 1, wherein said control circuit automatically positions said shunt to minimize the SWR of the antenna at the tuned frequency.

6. The antenna array according to claim 1, wherein one end of the gamma match rod is held in place by an insulator connected to the driven element.

7. A gamma matching tunable antenna array including an antenna driven element and a gamma match rod, comprising:

a movable shunt shorting between said driven element and gamma match rod to tune the antenna array to a desired frequency;

a screw connected to said movable shunt through a threaded hole;

a reversible motor connected to one end of said screw; and an automatic control circuit for driving said motor in a desired direction to move said shunt and to tune said antenna to a desired transmitting frequency and to minimize the SWR at the tuned frequency.

8. The antenna array according to claim 7, wherein said shunt has openings therein through which said driven element and gamma match rod extend, shorting the driven element and gamma match rod together.

9. The antenna array according to claim 7, wherein said shunt moves along and is in contact with said driven element and gamma match rod by rollers.

10. The antenna array according to claim 7, wherein said shunt moves along and is in electrical contact with said driven element and gamma match rod by compressible spring brushes.

11. The antenna array according to claim 7, wherein said control circuit automatically positions said shunt in response to the SWR of the antenna at the tuned frequency.

12. The antenna array according to claim 7, wherein one end of the gamma match rod is held in place by an insulator connected to the driven element.

13. Control circuit for tuning a gamma match antenna, comprising:

a shunt movable along a driven element and a gamma match rod on the antenna;

a reversible motor for moving the shunt along the driven element and gamma matching rod; and a detector circuit for detecting the SWR of the antenna, and moving the motor in a direction to position the shunt to minimize the SWR of the antenna at a desire frequency.

14. The control circuit according to claim 13, wherein said shunt is moved along the driven element and gamma match rod by a screw attached to said motor and extending through threads in the shunt.

15. The control circuit according to claim 13, wherein said shunt moves along and is in contact with said driven element and gamma match rod by rollers.

16. The control circuit according to claim 13, wherein said shunt moves along and is in contact with said driven element and gamma match rod by compressible spring brushes.

17. The control circuit according to claim 13, wherein the ends of the gamma match rod are held in place by an insulators connected to the driven element.

18. The control circuit according to claim 13, including a comparison circuit for determining the direction in which the shunt is to be moved;

a motor controller;

a shunt location, reflective power combiner for actuating the motor controller to turn the reversible motor in a direction to minimize the SWR of the antenna.

19. The control circuit according to claim 18, including a timing circuits to prevent the motor and control circuit from over reacting to movement of the shunt by the motor.

* * * * *